United States Patent [19]

Baldenko et al.

[11] Patent Number: 4,518,049

[45] Date of Patent: May 21, 1985

[54] BOTTOM HOLE MOTOR FOR DRIVING ROCK-BREAKING TOOL

[75] Inventors: Dmitry F. Baldenko; Moisei T. Gusman; Valery I. Semenets, all of Moscow, U.S.S.R.

[73] Assignee: Vsesojuzny Nauchno-Issledovatelsky Institut Burovoi Tekhniki, Moscow, U.S.S.R.

[21] Appl. No.: 622,381

[22] Filed: Jun. 18, 1984

Related U.S. Application Data

[63] Continuation of Ser. No. 261,211, May 1, 1981, abandoned.

[51] Int. Cl.[3] ..... E21B 4/02

[52] U.S. Cl. ..... 175/107; 418/48; 384/454

[58] Field of Search ..... 175/107; 415/502; 308/236; 418/48

[56] References Cited

U.S. PATENT DOCUMENTS

| | | | |
|---|---|---|---|
| 2,167,019 | 7/1939 | Yost | 175/107 |
| 2,207,187 | 7/1940 | Zublin | 175/107 |
| 2,898,087 | 8/1959 | Clark | 175/107 |
| 3,112,801 | 12/1963 | Clark et al. | 175/107 |
| 3,260,318 | 7/1966 | Neilson et al. | 175/107 |
| 3,356,338 | 12/1967 | Ioanesyan et al. | 175/107 |
| 3,879,094 | 4/1975 | Tschirky et al. | 418/48 |
| 3,930,749 | 1/1976 | Gusman et al. | 415/502 |
| 4,170,441 | 10/1979 | Trzeciak | 418/48 |
| 4,232,751 | 11/1980 | Trzeciak | 175/107 |

FOREIGN PATENT DOCUMENTS

| | | | |
|---|---|---|---|
| 2441837 | 3/1975 | Fed. Rep. of Germany | 175/107 |
| 568389 | 3/1924 | France . | |

*Primary Examiner*—Stephen J. Novosad
*Assistant Examiner*—William P. Neuder
*Attorney, Agent, or Firm*—Burgess, Ryan & Wayne

[57] ABSTRACT

A bottom hole motor for driving a rock-breaking tool comprises a motor unit kinematically coupled with a spindle unit. The spindle unit has a housing inside which extends a shaft connected with the rock-breaking tool and mounted in the housing with the aid of radial bearings and rings and races, said rings and races arranged coaxial with the shaft and designed to retain rolling bodies located between the rings, races and the shaft. The shaft has toroidal grooves which are in immediate contact with rolling bodies.

This invention can be used for drilling and repair of oil, gas and exploratory wells.

7 Claims, 2 Drawing Figures

BOTTOM HOLE MOTOR FOR DRIVING ROCK-BREAKING TOOL

This application is a continuation of application Ser. No. 261,211, filed May 1, 1981, now abandoned.

TECHNICAL FIELD

The present invention relates to mining and, more particularly, it relates to bottom hole motors for driving rock-breaking tools.

BACKGROUND ART

There is known in the art a bottom hole motor for driving a rock-breaking tool, comprising a motor unit coupled kinematically with a spindle unit having a housing. Passing inside said housing is a shaft connected with the rock-breaking tool and mounted in the housing with the aid of radial bearings and a thrust one. The thrust bearing is essentially a set of outer and inner races serving to retain balls located therebetween.

Irrespective of the configuration of the working surfaces of prior art races of the thrust bearing, provision is made for tightening the inner races located on the shaft and the outer races located in the spindle unit housing.

Said prior art bottom hole motor is used advantageously in drilling wells of large and medium diameter, however, a multicomponent nature of the spindle unit and relatively large cross-sectional area taken by the thrust bearing elements render the prior art structure unsuitable for drilling wells of small diameter due to impossibility to ensure its reliable and durable operation. This is due to the fact that the utilization of a conventional spindle unit structure when using the prior art bottom hole motor for drilling wells of small diameter calls for a reduced shaft diameter which, in turn, results in the reduction of permissible power developed by the bottom hole motor.

The choice of required shaft diameter from considerations of strength leads to a considerable reduction in the diameter of bearing balls, this leading to further reduction of the service life of the bottom hole motor because of the reduced carrying capacity of the balls used.

DISCLOSURE OF THE INVENTION

It is the object of the present invention to develop a bottom hole motor for driving a rock-breaking tool, featuring such a structural embodiment of the spindle unit as would ensure an increased durability and reliability of the bottom hole motor operation when drilling wells of small diameter, as well as facilitate considerably the repair operations.

The present invention resides in that, in a bottom hole motor for driving a rock-breaking tool, comprising a motor unit coupled kinematically with a spindle unit having a housing inside which passes a shaft connected with the rockbreaking tool and mounted in the housing with the aid of radial bearings, rings and races, said rings and races arranged coaxial with the shaft and the races and designed to retain balls located between the rings, the races and the shaft; according to the invention, the shaft has toroidal grooves which are in immediate contact with the bearing balls.

Such a structural arrangement permits increased dimensions of the rolling bodies at a fixed diameter of the shaft to be made which allows for considerably increasing the durability of both the thrust bearing and bottom hole motor as a whole, owing to an increased carrying capacity of the bearing balls.

It is expedient that the shaft portion carrying the balls with the rings and races be made as an insert, which will improve considerably the quality of manufacture of the shaft portion with toroidal grooves, as well as simplify the manufacturing technology of the shaft in general.

In addition, such a structural arrangement of the shaft renders the latter more compact, while the improved quality of toroidal grooves makes for a sharp increase of the thrust bearing life.

In order to ensure minimum contact stresses while fully ensuring the possibility of successive assembly of each specific series of the thrust bearing, as well as to maintain the shaft strength, it is expedient that the toroidal grooves for rolling bodies on said shaft be made such that the ratio of the radius of the toroidal cross-section to its inner diameter should lie substantially within the 0.1–0.25 range.

BRIEF DESCRIPTION OF THE DRAWINGS

The present invention will be more apparent upon considering the following detailed description of an exemplary embodiment thereof, with references to the accompanying drawings in which.

BEST MODE FOR CARRYING OUT THE INVENTION

Figure 1:
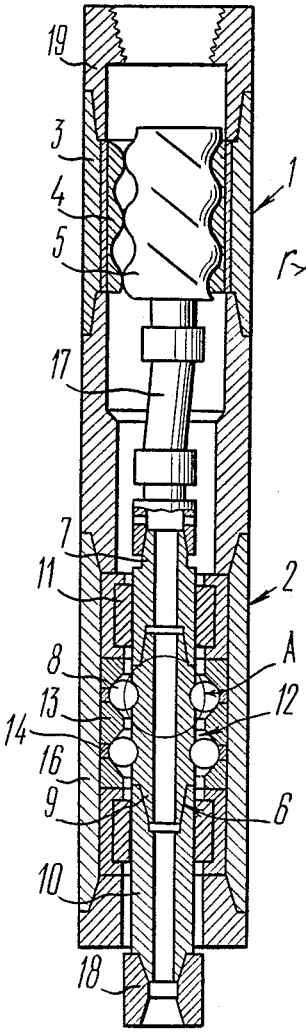
FIG. 1 is a general view of a bottom hole motor for driving rock-breaking tools, according to the invention, longitudinal section.
Figure 2:
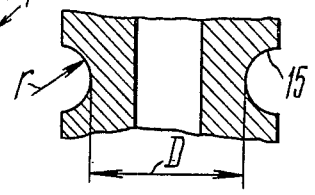
FIG. 2 is a view taken along arrow A of FIG. 1.

The bottom hole motor for driving rock-breaking tools comprises a motor unit 1 and a spindle unit 2. The motor unit 1 includes a body 3 which accommodates working members such as a helical stator 4 and a helical rotor 5 mounted therein.

The spindle unit 2 includes a composite shaft 6 consisting of an adapter 7, a portiion of the shaft 6 adapted to carry spherical rolling bodies 8 and made as an insert 9, and an output shaft 10, rubber-coated radial bearings 11 and a thrust bearing 12.

The thrust bearing 12 proper is a special multiple thrust-radial ball bearing including outer races 13 and rings 14 interacting with the bearing balls 8. The latter, in their turn, are in contact with toroidal grooves 15 provided on the outer surface of the insert 9. The outer races 13 and rings 14 are tightened into a monolith set with the aid of thread provided on a housing 16 of the spindle unit 2.

In the absence of technological difficulties when manufacturing the shaft 6, in general, and in the case of a high quality of manufacturing of the toroidal grooves 15, in particular, the shaft 6 is manufactured in one piece (not shown in the drawings).

The bottom hole motor for driving rock-breaking tools of the present invention further comprises a coupling element 17 serving to interconnect the helical rotor 5 of the motor unit 1 and the shaft 6 of the spindle unit 2, and an adapter 18 over the bit. The bottom hole motor is suspended from a drill or tubing string (not shown) with the aid of an adapter 19.

The bottom hole motor of the present invention for driving rock-breaking tools operates in the following manner.

Drilling mud is supplied to the bottom hole motor over the inner space of drill pipes through the adapter 19. When passing through the helical stator 4 and helical rotor 5, drilling mud acts to rotate the latter and is delivered to the bottom hole via inner holes in the adapter 7, insert 9 and output shaft 10. The torque developed in the motor unit 1 is transmitted from the helical rotor 5 to the shaft 6 of the spindle unit 2 via the coupling element 17.

An axial force arising in the helical rotor 5 from the hydraulic load and forces acting in the stator-rotor pair, as well as from the load from the bottom hole, is taken up by the thrust bearing 12, while radial loads caused by unbalance of the shaft 6 and by other factors are taken up by the rubber-coated radial bearings 11.

Axial loads from the insert 9 are transmitted via the balls 8 to the outer race 13 and further to the housing 16. The angle of contact is selected such as to ensure the minimum contact stresses while fully ensuring the possibility of successive assembly of each specific series of the thrust bearing 12. The dimensions of the balls 8 and diameter of the toroidal grooves 15 are selected with the same considerations, while retaining the strength of the shaft 6. It has been found a reduction of diameter of the balls 8, at the same size or slight increase of the toroidal grooves 15 provided on the insert 9, affects considerably the carrying capacity of the thrust bearing 12.

At the same time, as shown by relevant studies, a reduction of diameter causes, along with deterioration of the carrying capacity, progressing wear of the rolling bodies 8, especially, in open-type bearing such as the thrust bearing 12 of the bottom hole motor for driving a rock-breaking tool. This process tends to get more intensive in the presence of abrasive particles in drilling mud pumped through the bottom hole motor.

However, an increased size of the balls 8 may lead to a reduced safety margin of the shaft 6 when transmitting high torques whose absolute value increases sharply upon instantaneous stoppage of the shaft 6 of the bottom hole motor (braking state). This imposes necessary technological limitations on the bottom hole motor operation (such as reduced flow rate of drilling mud which, in turn, results in a reduction of permissible power developed by the bottom hole motor).

Therefore, the ratio of the radius r of the cross-section of the toroidal groove 15 to its inner diameter D should lie substantially within the 0.1–0.25 range.

The herein disclosed design of a bottom hole motor for driving a rock-breaking tool, featuring the recommended dimensions of the toroidal groove 15 for the balls 8, provides an increased load capacity of the thrust bearing 12 owing to a more efficient utilization of the cross-sectional area designed to accommodate large-size balls 8 as compared with the prior art bottom hole motor thrust bearing. In addition, the assembly of the spindle unit 2 is facilitated owing to a small number of components in the latter and to the obviation of the need to tighten the set of inner races of the thrust bearing 12 on the shaft 6.

INDUSTRIAL APPLICABILITY

The present invention may be used for drilling and repair of oil, gas and exploratory wells. This invention can also be used in other bottom hole mechanisms.

We claim:

1. A bottom hole drill, comprising:

a motor unit;

a spindle unit having a housing;

a shaft extending through said housing and connected at one end to said motor unit;

radial bearings located between said housing and said shaft;

a thrust-radial bearing comprising;

a plurality of races and rings secured within said housing coaxially with said shaft, peripheral annular grooves formed on the outer surface of said shaft, and rolling bodies provided between said races, rings, and annular grooves; and a rock-breaking tool mounted at the other end of said shaft.

2. A bottom hole drill as claimed in claim 1, wherein said shaft is formed by sections adapted for axial assembly, said peripheral annular grooves being provided on an insert serving as one of said sections.

3. A bottom hole drill as claimed in claim 1 or 2, wherein said peripheral annular grooves have a toroidal shape.

4. A bottom hole drill as claimed in claim 3, wherein said peripheral annular grooves are so formed that the ratio of the radius of the groove cross-section to its inner diameter lies substantially between 0.1 and 0.25.

5. A bottom hole drill, comprising:

a motor;

a spindle assembly having a generally cylindrical housing;

a shaft extending through said housing and coupled at one end to said motor;

a radial bearing disposed within said housing and coupling an outer surface portion of said shaft to an inner surface portion of said housing, to restrict radial movement of said shaft relative to said housing while permitting rotation of said shaft about an axis parallel to or coaxial with the axis of said housing;

a thrust-radial ball bearing assembly disposed axially of said radial bearing with said housing and comprising a plurality of axially adjacent thrust-radial bearing sets, each thrust-radial bearing set comprising:

an inner race in the form of a toroidal peripheral groove formed in the outer surface of said shaft, a corresponding coaxial outer race formed by two axially juxtaposed race sections and a ring between said sections, said race sections and ring cooperating to form an annular groove radially outward of said toroidal peripheral groove, and a plurality of balls disposed between said inner race and said outer race and axially retained in position by said grooves; and a tool mounted on the other end of said shaft.

6. The bottom hole drill according to claim 5 wherein said shaft is formed in sections adapted to be axially assembled, said inner races being formed on an insert forming one of said sections.

7. The bottom hole drill according to claim 5 wherein said to-roidal grooves are formed such that the ration of the radius of the cross-section to its inner diameter lies substantially within 0.1–0.25.

* * * * *